US005127171A

United States Patent [19]

Stampacchia

[11] Patent Number: 5,127,171

[45] Date of Patent: Jul. 7, 1992

[54] SKI BOOT WITH A TRANSLATING REAR

[75] Inventor: Marcello Stampacchia, Treviso, Italy

[73] Assignee: Lange International, Fribourg, Switzerland

[21] Appl. No.: 564,432

[22] Filed: Aug. 8, 1990

[30] Foreign Application Priority Data

Aug. 28, 1989 [CH] Switzerland ..... 3110/89

[51] Int. Cl.[5] ..... A43B 5/04

[52] U.S. Cl. ..... 36/120; 36/117

[58] Field of Search ..... 36/117–121

[56] References Cited

U.S. PATENT DOCUMENTS

| | | | |
|---|---|---|---|
| 4,602,443 | 7/1986 | Spademan | 36/120 |
| 4,918,842 | 4/1990 | Lederer | 36/120 X |
| 4,922,635 | 5/1990 | Zanco | 36/119 X |
| 4,928,408 | 5/1990 | Baggio et al. | 36/119 |

FOREIGN PATENT DOCUMENTS

| | | | |
|---|---|---|---|
| 0123636 | 10/1984 | European Pat. Off. | 36/120 |
| 3247516 | 6/1984 | Fed. Rep. of Germany | 36/120 |

*Primary Examiner*—Paul T. Sewell
*Assistant Examiner*—BethAnne Cicconi
*Attorney, Agent, or Firm*—Kane, Dalsimer, Sullivan, Kurucz, Levy, Eisele and Richard

[57] ABSTRACT

Boot with a shell (1) comprising a shaft in two parts (2, 4), the rear part (4) of which is connected, on the one hand, to the shell and, on the other hand, to the front part (2) of the shaft by two pairs of links (5, 7) or equivalent means. The axes of the articulations on the rear part (4) are situated, in the closed position of the boot, on one side and the other of the plane containing the axes of articulation on the shaft and the front part (2) of the shaft. It is possible to open the shaft wide for putting the boot on, while having only a limited tilting backwards of the rear part. The upper connection can be associated with a closing lever.

18 Claims, 6 Drawing Sheets

SKI BOOT WITH A TRANSLATING REAR

FIELD OF THE INVENTION

The present invention relates to a ski boot consisting of a shell surrounding the foot and the heel and of a shaft consisting of a front part and of a rear part capable of being tilted towards the rear in order to free the foot and to allow the boot to be put on and taken off, in which the rear part of the shaft can perform a translation movement in addition to a rotation movement.

PRIOR ART

From U.S. Pat. No. 4,759,137, a ski boot is known, the front part of the shaft of which is articulated at its lower end about two axes which pass through two opposite slots of the rear part of the shaft, so that this rear part can perform a translation displacement in addition to its rotation about its articulation on the shell. The front part of the shaft is also translationally displaceable, the two translation displacements being intended to facilitate the introduction of the foot into the boot. The rear part of the shaft can tilt backwards extensively. However, such an extensive tilting backwards is not judicious when non-packed snow is abundant and may penetrate the boot.

It has also been proposed to connect the rear part of the shaft by an articulation of the parallelogram type (WO 85/04557). In such a construction, the lower part of the shaft unnecessarily opens as extensively as the upper part, allowing snow to penetrate the boot. Moreover, the end of the closing movement consists in a maximum pressure accompanied by a descending movement which has a tendency to deform an inner boot and to crush it onto the heel.

Also known are numerous ski boots, the front part of the shaft of which can simply perform a rotation movement backwards. These boots have the same disadvantage as the boot mentioned previously.

SUMMARY OF THE INVENTION

The object of the present invention is to produce a boot of the type defined above, the rear part of the shaft of which moves away from the front part sufficiently to allow it to be put on comfortably, but only tilting slightly backwards, so that the risk of penetration of snow into the boot is reduced considerably.

The ski boot according to the invention is characterized by the fact that the rear part of the shaft is connected, on the one hand, in its lower part to the shell by a first means of connection which allows a rotation of said part in relation to a defined axis of the shell and, on the other hand, in its upper part to the front part of the shaft by a second means of connection which allows a rotation of said rear part in relation to a defined axis on the front part, the axes of the articulations of the means of connection on the rear part of the shaft being situated, in the closed position of the boot, on one side and the other of the plane containing the axes of the articulations of the means of connection on the shell and the front part of the shaft.

The two means of connection ensure a single perfectly defined trajectory for the rear part of the shaft at the time of its displacement in contrast to the boot according to prior art in which the rotation and translation movements of the rear part of the shaft are independent of one another, which is precisely what allows the rear part of the shaft to tilt freely backwards. Moreover, even if the connections are parallel and of equal lengths, the rear part of the shaft still performs a roto-translation movement which ensures sufficient opening of the boot.

The means of connection can be realized by any mechanical means, in particular by means of a link or of a pivot which is integral with the rear part and is displaced in a groove in the form of a circular arc provided either in the shell or in the front part of the shaft.

By means of a judicious choice of the orientation of the links, or of the position of the pivots in the grooves in the form of a circular arc respectively, and of the length of the links and of the radii of the grooves, it is possible to obtain the desired opening and tilting.

BRIEF DESCRIPTION OF THE DRAWINGS

The attached drawing represents, by way of example, four embodiments of the invention.

DESCRIPTION OF THE PREFERRED EMBODIMENTS

Figure 1:
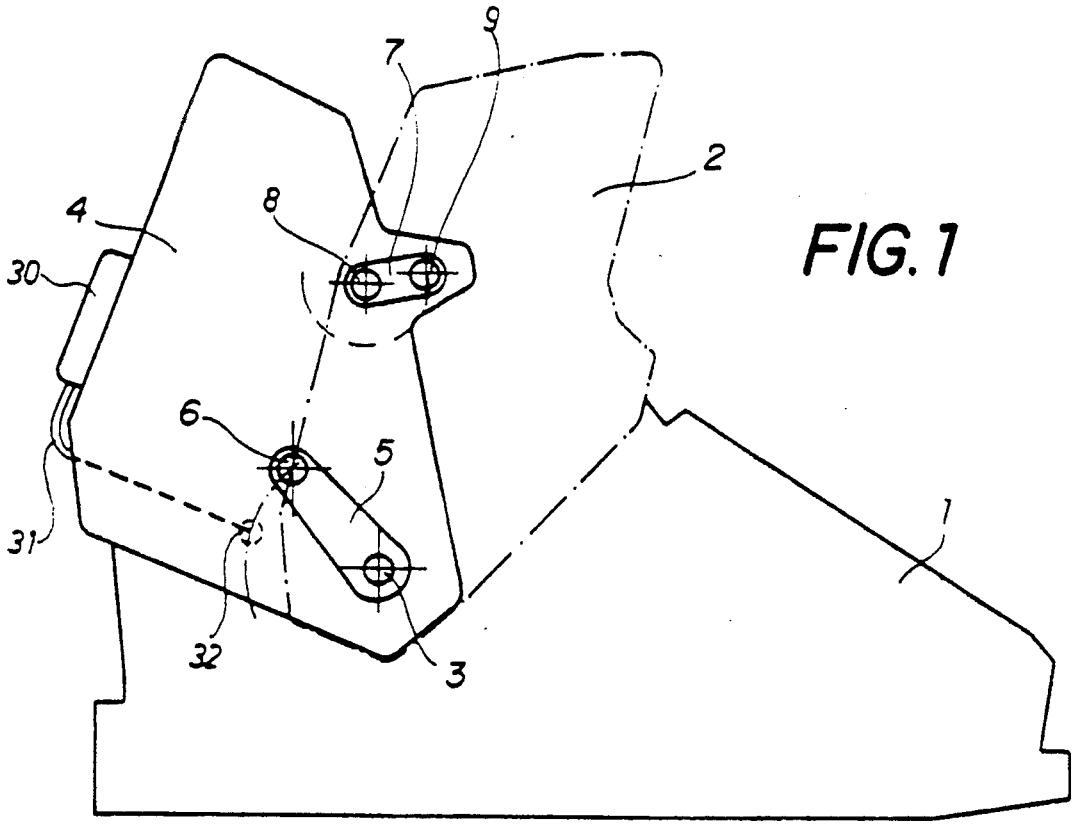
FIG. 1 is a schematic view of a boot according to a first embodiment in the closed position.

The boot represented in FIG. 1 consists of a shell 1 surrounding the foot and the heel and of a shaft consisting of a front part 2 articulated on the shell 1 about an axis 3 and of a rear part 4 which is likewise articulated. The boot also comprises tightening means such as a buckle or tension lever at the rear. The rear part 4 of the shaft is articulated on the shell 1, on each side of the latter, by means of a link 5, one end of which is articulated about the axis 3 and the other end is articulated on the rear part 4 about an axis 6. The rear part 4 of the shaft is moreover connected to the front part 2 of the shaft, on each side of the latter, by a second pair of links 7 which are articulated at a point 8 on the front part 2 and at a point 9 on the rear part 4.

The axes of the articulations 6 and 9 on the rear part of the shaft are situated on one side and the other of the plane, approximately vertical, containing the axes of the articulations 3 and 8. Moreover, in this example, the links are not parallel and the links 5 are approximately twice as long as the links 7.

The front part 2 of the shaft of course covers the rear part 4, for which reason the part 2 has been represented in dot-dash lines so as to allow a better view of the means of connection which are normally concealed, at least in the closed position of the boot, by the front part 2 of the shaft.

Figure 2:
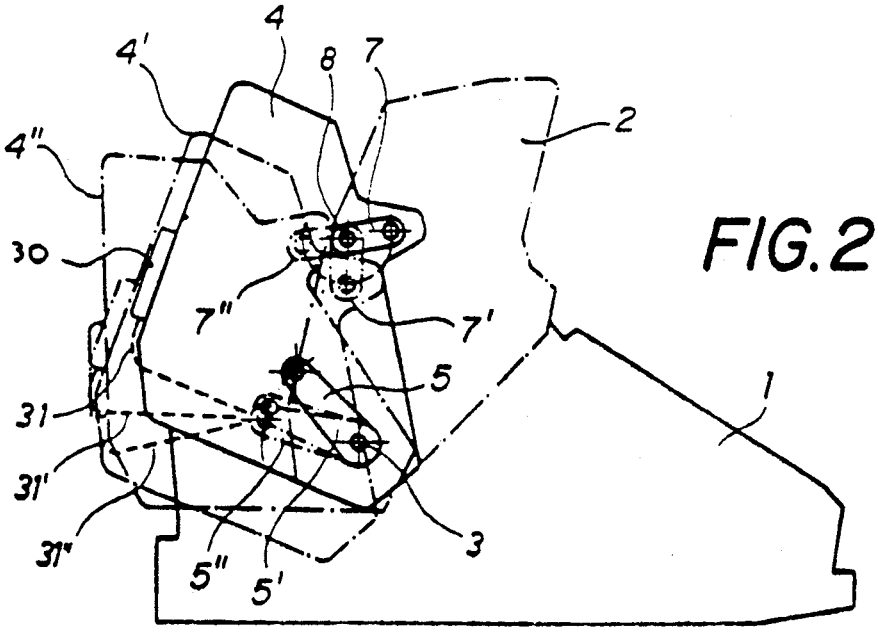
FIG. 2 represents schematically three successive positions of the rear part of the shaft of the boot represented in FIG. 1.

FIG. 1 represents the shaft of the boot in the closed position. In FIG. 2, two other positions have been represented in dot-dash lines, namely an intermediate position 4' and the maximum opening position 4''. Positions 5' and 5'' of the lower links and 7' and 7'' of the upper links correspond respectively to these positions. It can be observed that passing from position 4 to position 4' corresponds approximately to a translation. As far as the open position 4'' is concerned, it can be observed that the shaft is open wide, allowing comfortable putting-on and taking-off, whereas the rear part 4 of the shaft is practically vertical.

Figure 3:
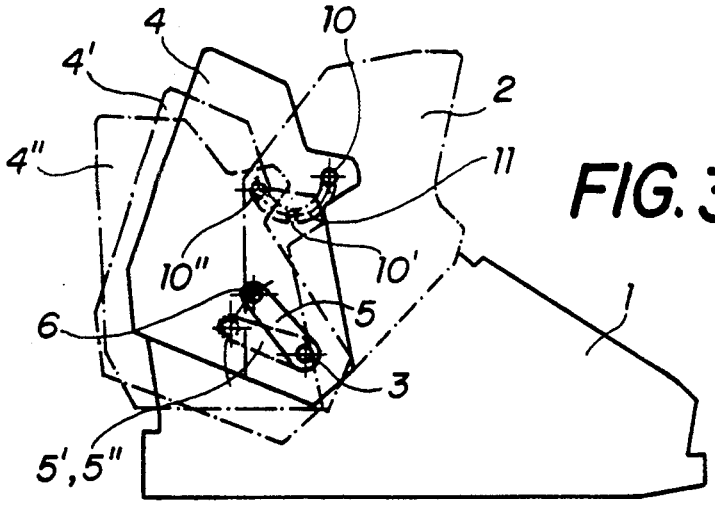
FIG. 3 represents schematically a second embodiment with the rear part of the shaft represented in three different positions.

In the second embodiment represented in FIG. 3, the means of connection of the rear part 4 of the shaft are the same as in the first embodiment. On the other hand, the means of connection of the upper part of the part 4 to the front part 2 of the shaft consist, on each side of the boot, of a stud or pivot 10 which is integral with the rear part 4 and is displaced in a groove in the form of a circular arc 11 formed in the front part 2 of the shaft. The groove 11 is the equivalent of a link articulated at the center of the circular arc of the groove. Once again, in addition to the closed position 4, an intermediate position 4' and the completely open position 4'' have been represented. Positions 10' and 10'' of the pivot 10 and positons 5' and 5'' of the link 5 correspond to these positions. Positions 5' and 5'' are very close to one another and, for the sake of clarity of the drawing, only one single position has been represented. Once again, it can be observed that, in the completely open position, the rear part 4 of the shaft is practically vertical.

Figure 4:
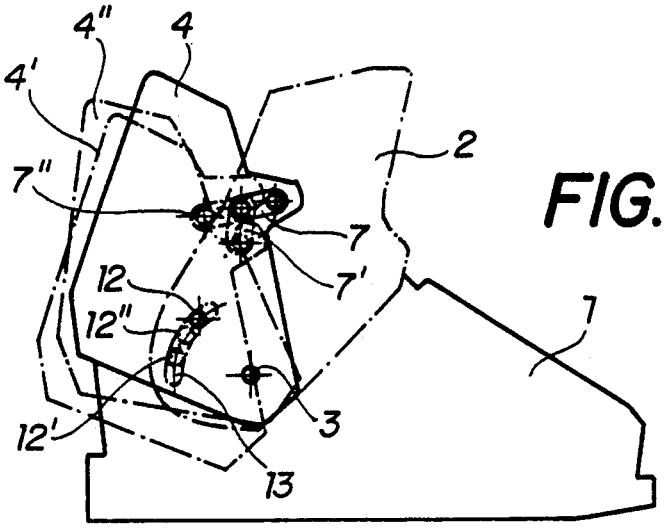
FIG. 4 represents schematically a third embodiment, in which the rear part of the shaft is represented in three different positions.

In the third embodiment represented in FIG. 4, the means of connection between the front part 2 and the rear part 4 of the shaft consist of a pair of links 7 as in the first embodiment. On the other hand, the means of connection of the rear part 4 of the shaft to the shell 1 consist, on each side of the boot, of a pivot 12 which is integral with the rear part 4 and is displaced in a groove in the form of a circular arc 13 formed in the shell 1. The circular arc is in this case centered on the axis 3 of the articulation of the front part 2 of the shaft. As an alternative, the groove 13 could be formed in the internal wall of the front part 2 of the shaft. Once again, in addition to the closed position 4, an intermediate position 4' and the completely open position 4'' have been represented. The links 7 respectively occupy the corresponding positions 7' and 7'' and the pivot 12 the positions 12' and 12''. Once again, it can be observed that the rear part of the shaft is practically vertical in the open position 4''.

Figure 5:
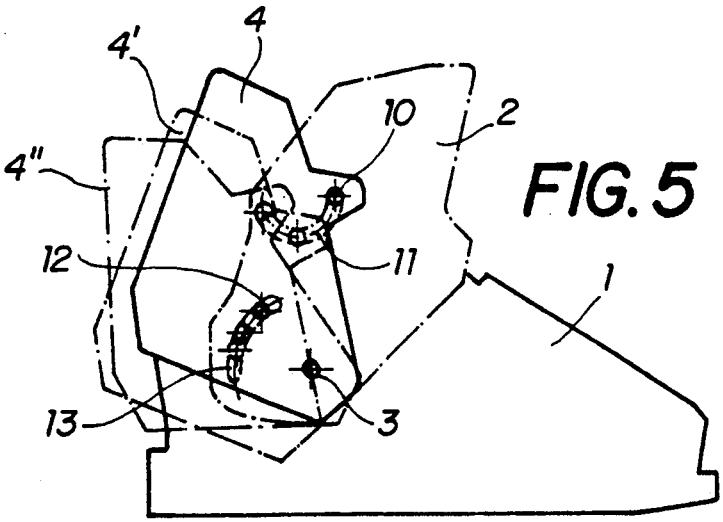
FIG. 5 represents schematically a fourth embodiment, in which the rear part of the shaft is represented in three different positions.

The fourth embodiment represented in FIG. 5 is a combination of the second and third embodiments. The means of connection between the rear part 4 and the shell 1 are produced as in FIG. 4, whereas the upper means of connection between the two parts of the shaft are produced as represented in FIG. 3. This embodiment does not, therefore, comprise links but pivots 10 and 12 which are guided respectively in grooves in the form of a circular arc 11 and 13. Once again, an intermediate position 4' and a completely open position 4'' have been represented.

The links 5 do not necessarily have to be articulated about the axis 3 of the articulation of the front part 2 of the shaft on the shell 1, but they can be articulated at a point which is separate from this axis 3. Similarly, the grooves in the form of a circular arc 13 do not necessarily have to be centered on the axis of articulation 3. The front part 2 of the shaft could be non-articulated.

In FIG. 2, positions 5' and 5'' of the link 5 are in reality closer than represented. An exact representation would have led to an overlapping of the lines. This also applies to FIGS. 3 to 5. It is possible to take advantage of this characteristic in a case in which the boot is equipped with a tension device 30 at the rear which acts on a cable 31 which ensures the gripping of the instep in known manner. Consider a cable 31 which penetrates the shell at a point 32 (FIG. 1) and coincides with the position of the articulation 6 when the link 5 is in the position 5''. When the transition is made from the completely open position 4'' to the intermediate position 4', the rear part 4 of the shaft practically performs a rotation about a fixed point, at the end of the link 5. The cable 31 "turns" about the same point and there is then no traction on the cable, that is to say no gripping of the foot. Subsequently, when the transition is made from position 4' to the closed position 4, the rear part 4 is displaced upwards essentially translationally and this movement has the effect of exerting traction on the cable 31, that is to say a gripping of the foot. In short, the first part, essentially rotational, of the closing movement is preformed without gripping, that is to say without resistance, whereas the second part of the movement, consisting essentially of a translation, brings about gripping of the foot. The amplitude of the translation, and therefore the gripping, is perfectly controllable.

Figure 6:
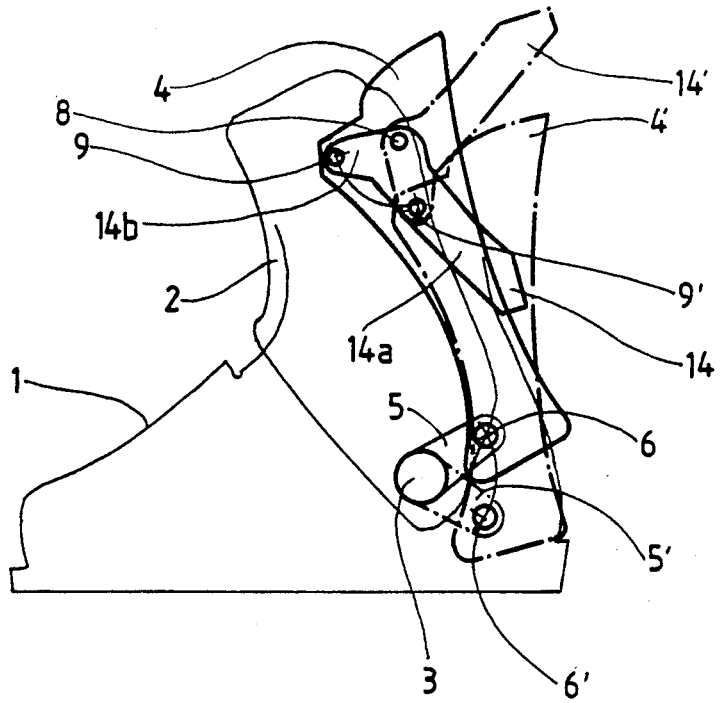
FIG. 6 represents a boot according to the first embodiment, equipped with a closing lever.

The boots described can be closed simply by pushing the rear part 4 of the shaft towards the front and the gripping is then carried out by means of a strap surrounding the shaft. It would, however, be more convenient to close the shaft of the boot by a vertical action which can be effected not only by means of the hand but, if the case arises, by means of the foot. The boot according to the invention proves to lend itself very well to such closing. FIG. 6 represents an example of a boot according to the first embodiment, provided with a closing lever which simultaneously ensures gripping. For reasons of simplicity, the shell and the two parts of the shaft, as well as the articulations, have been designated by the same references as in FIGS. 1 and 2. The boot is equipped with a lever 14 in the form of a stirrup, the lateral arms 14*a* of which are articulated at 8 and 9, that is to say at the points of articulation of the links 7 in FIG. 1. The arms 14*a* have an elbowed shape, the shorter part 14*b* of which performs the role of the link 7. The arms 14*a* thus constitute two levers, the support points of which are the articulations 8 on the front part 2 of the shaft, these two levers being joined together to form the lever 14.

It will be noted that, in this embodiment, the center distances of the axes of the articulations are equal, which does not make it impossible to have a quite pronounced roto-translation movement which would be even more pronounced if the links were parallel.

The open position of the boot is represented in dot-dash lines. In this position, the rear part of the shaft occupies the open position 4' which is lowered in relation to its closed position. The closing lever, in contrast, is in a raised position 14'. In order to close the boot, it is only necessary to press on the lever 14 as indicated by the arrow. The lowering of the lever 14 has the effect of making the rear part 4 of the shaft rise again and close in a rotation and translation movement. The lever 14 finally comes to fall back onto the rear part 4. The lever 14 ensures not only the closing of the shaft of the boot but also its grip around the leg. In fact, the lever arms 14*b* are situated in a plane which is essentially perpendicular to the axis of the shaft of the boot, so that the forces which have a tendency to open the shaft of the boot are exerted parallel to the straight line connecting the axes of the articulations 8 and 9, so that the couple exerted about the axis 8 is zero or acts in the direction of closing. In other words, the effect is one of a toggle joint. It is thus possible to do without any other system of tightening the shaft of the boot such as a strap or a cable system. The boot thus produced is, therefore, ultimately very simple, in spite of its advantages for use. The lever 14 can be lowered by means of the other foot. The amplitude of the opening can be defined by the length of the links or equivalent. It is possible to provide means of adjustment of the tightening by means which allow the length of the center distances of the axes between the articulations 8 and 9 to be modified.

Figure 7:
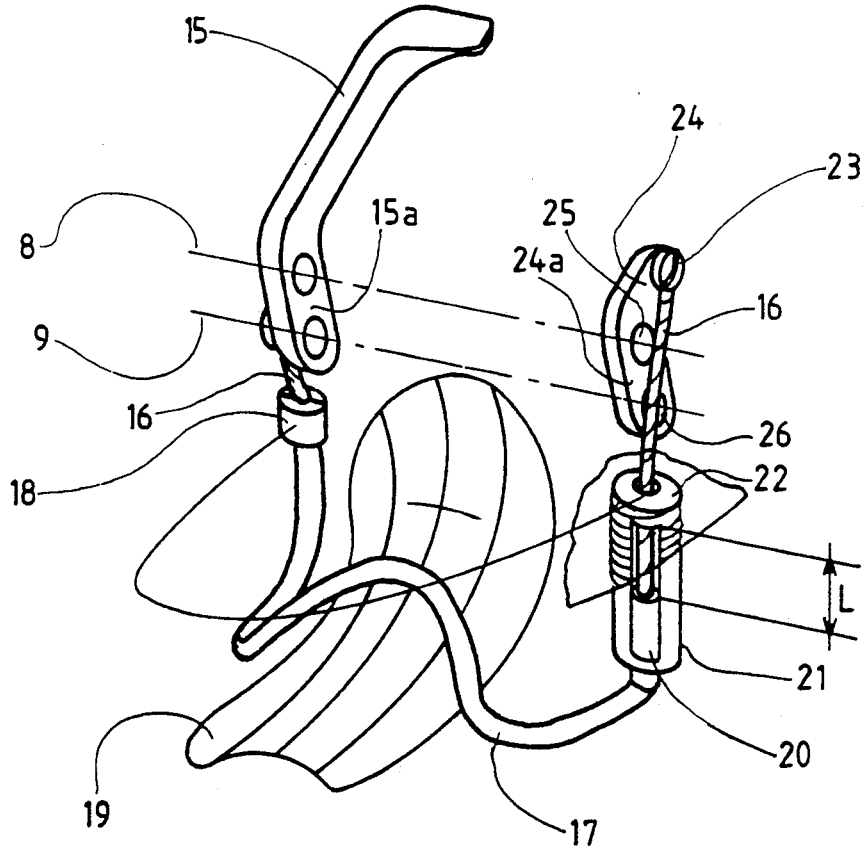
FIG. 7 represents, schematically, a closing and tightening device which is applicable to the first and to the third embodiments.

Instead of using a lever in the form of a stirrup like the lever 14, it is possible to use a lever mounted on the outer side of the boot which acts by means of a cable on the other side of the boot. An embodiment is represented schematically in FIG. 7. The boot consists of the same parts as the boot represented in FIG. 6 and only the axes of the articulations 8 and 9 have been represented. An elbowed lever 15 is provided, which is like the lever 14 and articulated at an intermediate point on the articulation 8 of the front part of the shaft of the boot, this lever 15 having a lever arm 15*a*, the end of which is articulated about the axis 9 on the rear part of the shaft. At the end of the lever arm 15*a*, the end of a cable 16 is also fixed. This fixing is rotary, the axis of rotation of the pivot coinciding or not with the axis 9. The cable 16 is guided inside a sheath 17, like a bicycle cable, the sheath passing over the instep between shell 1 and the front part 2 of the shaft. That end 18 of the sheath 17 close to the lever 15 is fixed to the front part 2 of the shaft. A pressure distributor 19 in the form of a horse saddle situated on the inside of the boot in the area of the instep has been represented schematically. The other end of the sheath 17 consists of a rigid and smooth cylinder 20 engaged in a bush 21, the outer surface of which has a thread, this bush being screwed into a tapped seat formed in the front part 2 of the shaft. The cable 16 passes through the base 22 of the bush 21 and its end is attached to a pivot 23 mounted on one of the ends of a small elbowed lever 24 which is articulated at an intermediate point 25 on the front part 2 of the shaft about the axis 8 and at a second point 26 on the rear part 4 of the shaft about the axis 9. The arm 24*a* performs the role of one of the links 7 in FIG. 1.

The levers 15 and 24 are represented in the open position. In order to close the boot, it is only necessary to lower the lever 15, which has the effect of drawing the rear part 4 of the shaft, by one of its sides, into a roto-translation movement such as was described previously. At the same time, the lever 15 exerts traction on the cable 16. This traction has a tendency to straighten the sheath 17. This straightening is possible without encountering any great resistance, because the cylindrical end 20 can penetrate the bush 21. The distance L, that is to say the travel of the cylindrical part 20 until it abuts against the base 22 of the bush, is sufficient to allow the closing of the shaft. This travel can be adjusted by screwing the bush 21 in or out of its seat. Once the cylindrical part 20 of the sheath abuts against the base 22 of the bush, the cable 16 works like a bicycle cable, that is to say by exerting greater traction on the lever 24. It is thus ensured that the toggle joint effect achieved by the lever 15 is also brought about at the lever 24. In this case also, there is no need for other means of closing and of tightening the shaft of the boot.

Figure 8:
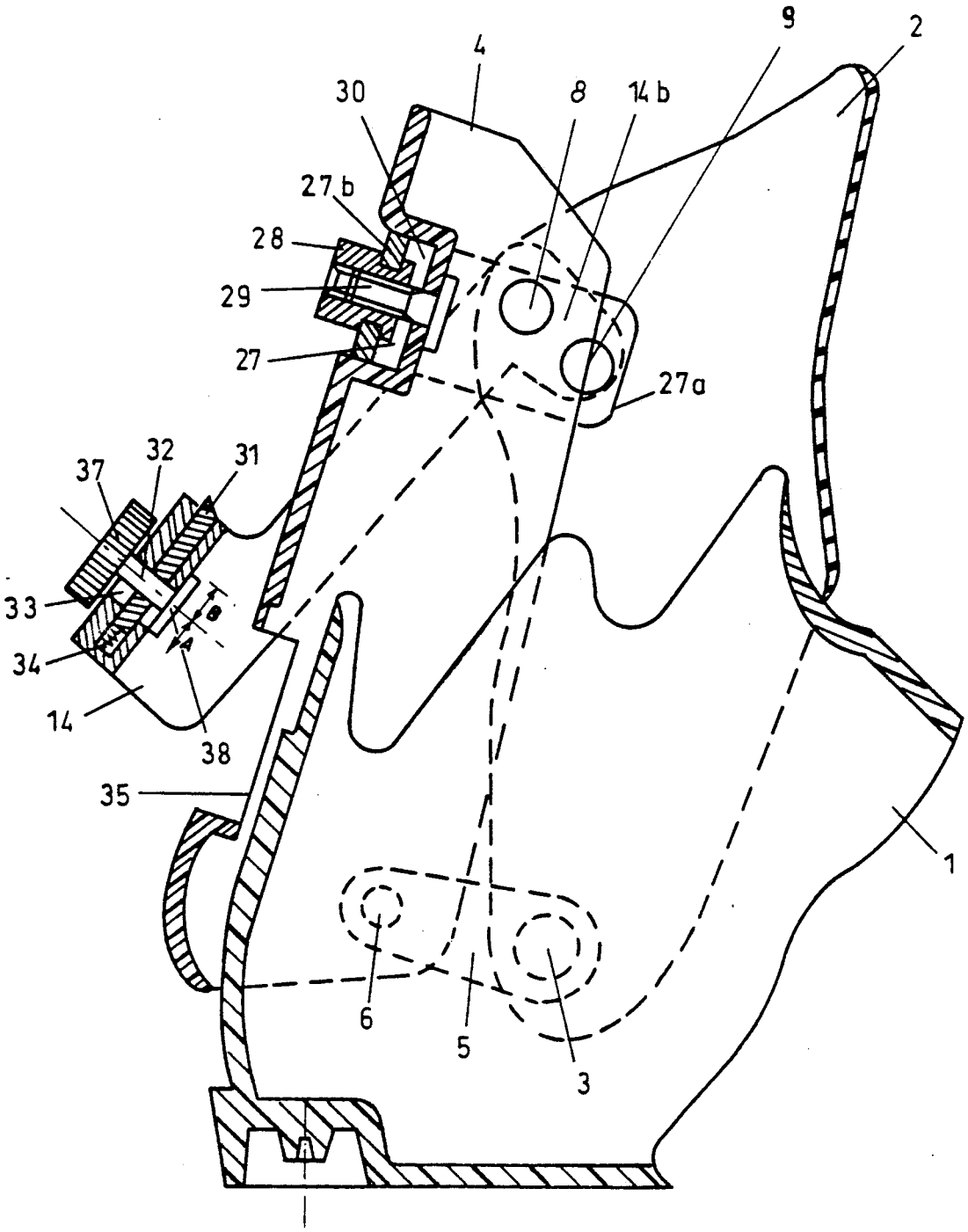
FIG. 8 is a partial view, in vertical cross-section, of an improvement of the embodiment according to FIG. 6, in the semi-closed position.
Figure 9:
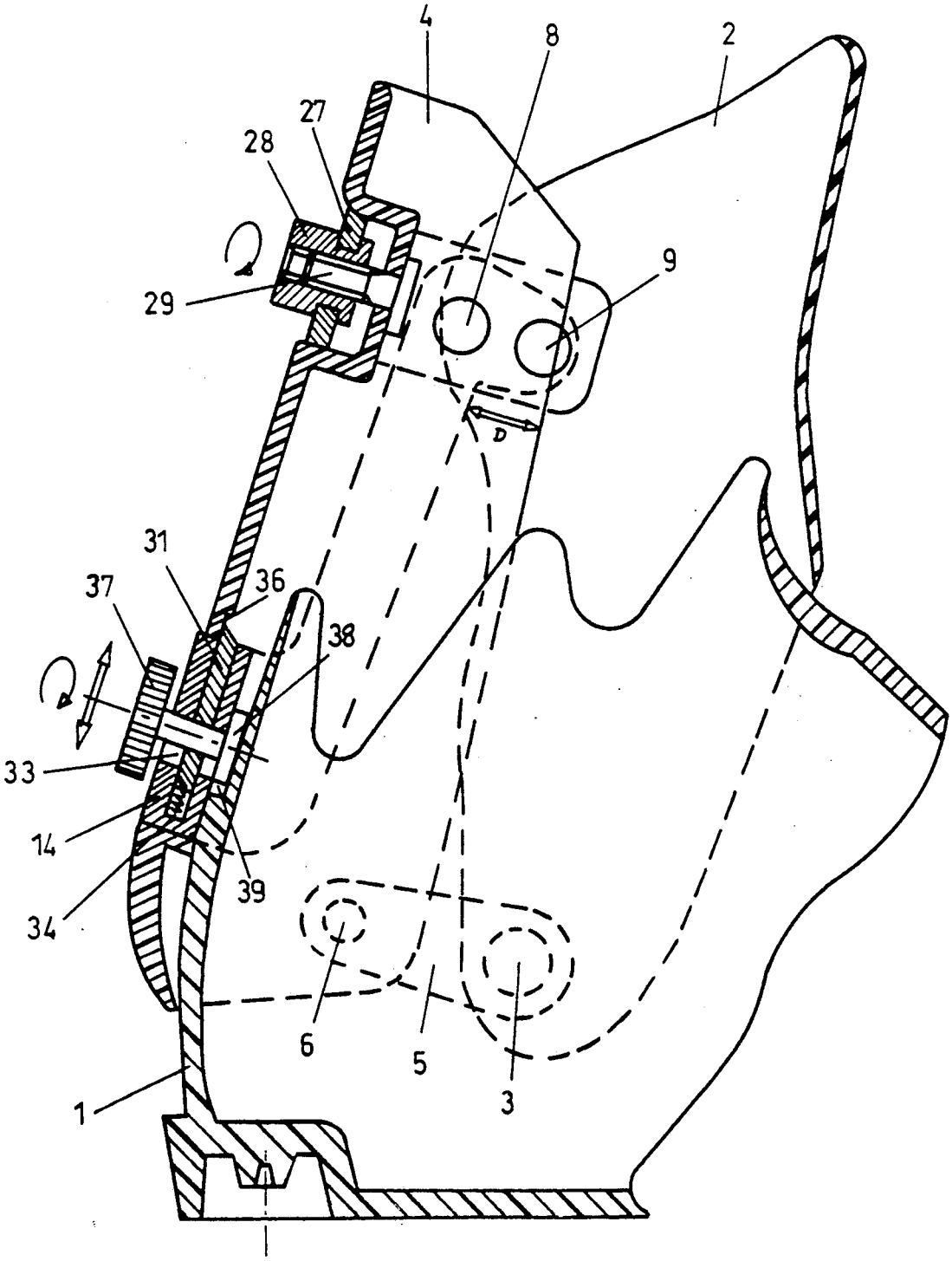
FIG. 9 represents the boot according to FIG. 8, in the closed position.

FIGS. 8 and 9 represent a boot of the same type as those represented in FIG. 6 but with several improvements.

The articulation points 8 of the lever 14 are no longer situated directly on the rear part 4 of the shaft, but on a rigid U-shaped piece, the arms 27*a* of which extend parallel towards the front on each side of the rear part 4 of the shaft. The articulations 8 are situated on each of these arms 27*a*. The middle part 27*b* of the piece 27 is integral with a nut 28 which is mounted rotatably on the piece 27 and screwed onto a screw 29 fixed to the rear part 4 of the shaft. This rear part 4 has a section 30 in the form of a throat in which the U-shaped piece 27 is guided. By turning the nut 28, the position of the U-shaped piece 27 in relation to the rear part 4 of the shaft is modified, which has the effect of modifying the position of the articulations 8 in relation to the rear part 4, in the closed position. The modified length is represented by the double arrow D in FIG. 9. The nut 28 thus makes it possible to modify the cross-section of the upper part of the shaft in the closed position, in the area of the calf of the skier, that is to say to modify the pressure exerted by the boot on the calf.

In the boot represented in FIGS. 8 to 9, the lever 14 can moreover be locked in the closed position by means of a bolt 31 which consists of a small plate mounted slidably in the thickness of the transverse part of the lever 14. This bolt 31 is passed through by a pin 32 which also passes through the lever 14 via a slot 33 which extends in a vertical plane. The bolt 31 is pushed into its operational position by a spring 34 accommodated in the lever 14. The bolt 31 is in the form of a door bolt and has an edge in an inclined plane. The rear part 4 of the shaft has a rectangular cut-out 35 which allows the fitting of the central transverse part of the lever 14 into the shaft of the boot when this lever is brought down against the boot. At the time of this bringing down, the bolt 31 automatically comes to lock itself behind a bearing surface 36 of the upper edge of the cut-out 35, as represented in FIG. 9. The pin 32 is provided with a button 37 which allows the bolt 31 to be pushed downwards in order to unlock the handle 14 and open the boot.

The boot represented in FIGS. 8 and 9 also comprises means of adjustment of the inclination of the shaft of the boot towards the front. These means consist of a small rectangular plate 38 mounted eccentrically on the internal end of the pin 32. In the closed position of the boot, the small plate 38 comes to be positioned above a bearing surface 39 formed on the shell 1. This bearing surface 39 serves as a stop for the small plate 38 when the shaft of the boot has a tendency to pivot towards the rear. The small plate 38 can be brought into rotation by means of the button 37. According to the position of the small plate 38, the distance between the pin 32 and the stop 39 is equal to A or B, A and B corresponding to two different inclinations of the shaft of the boot. The small plate 38 could of course have any other polygonal or rounded contour.

The lever 14 is thus used as a rigid support for two devices. In the closed position, the fitting of the lever 14 into the rear part 4 of the shaft ensures the continuity of the latter. It can be observed in FIG. 9 that the construction is particularly simple and compact.

Figure 10:
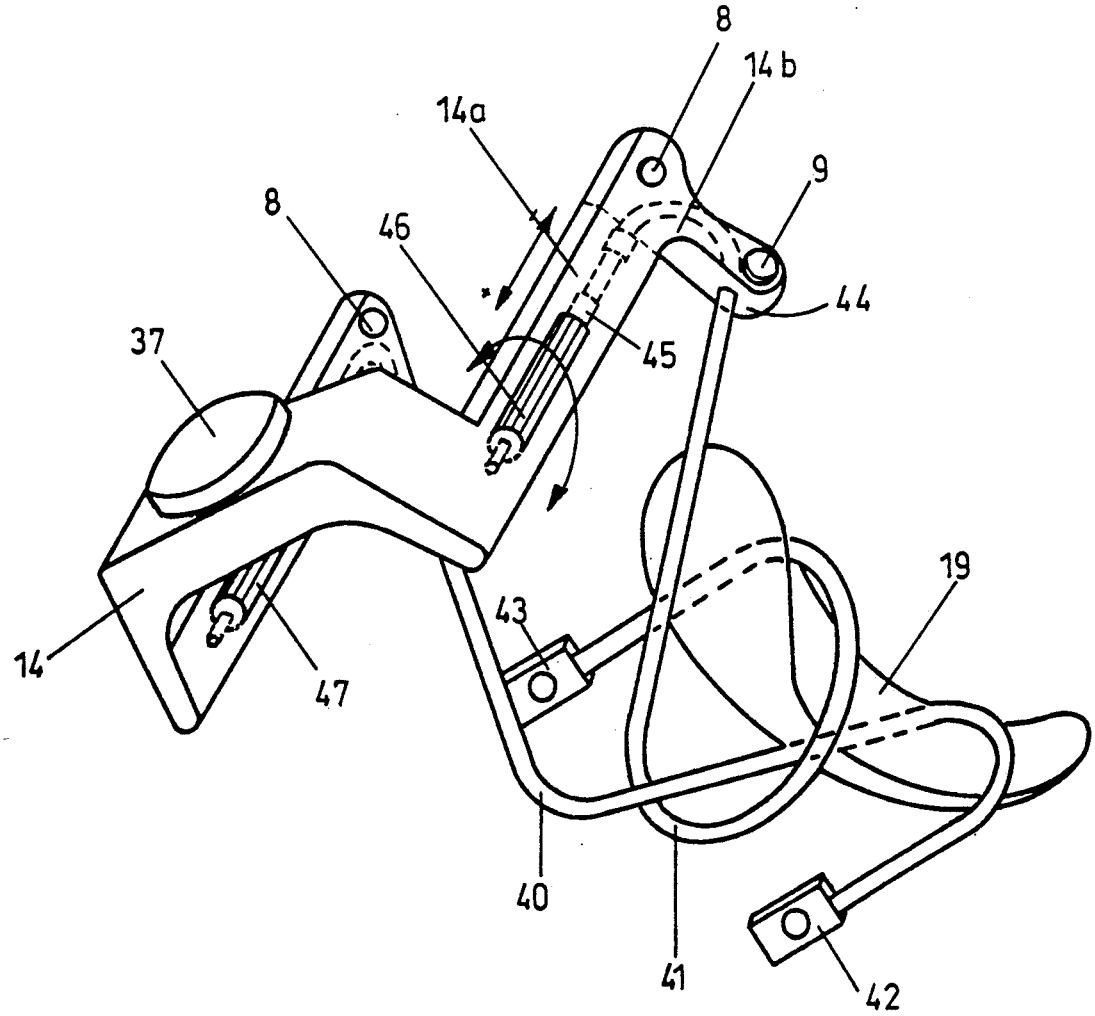
FIG. 10 partially represents another improvement of the boot according to FIG. 6.

FIG. 10 represents another manner of using the lever 14 in FIG. 6. The lever 14 is in this case used in an auxiliary manner for the gripping of the foot by means of two cables 40 and 41 which pass, on the inside of the shell, over a distribution plate 19 similar to the plate represented in FIG. 7 but extending further forwards over the foot. One of the ends of the cable 40 is fixed to the inside of the boot, on the side of the latter, by means of a small plate 42, so that the cable 40 passes over the front part of the distribution plate 19. The inner end of the cable 41 is fixed in the same manner, on the other side of the shell and further back, by means of a small plate 43 in such a manner that the cable 41 passes over the instep. The other end of the cable 41 penetrates the lever arm **14*b* of the lever 14, at the end of this arm, via a hole 44, and then it is led to the lever arm 14*a* where it ends in a threaded stud 45 screwed into a tapped bush 46 which is rotatably mounted in the lever arm 14*a*. In a similar manner, the other end of the cable 40 is connected to a tapped bush 47 mounted in the other arm 14*a* of the lever 14. The bush 46 makes it possible to adjust the active length of the cable 41, that is to say the gripping of the instep, whereas the bush 47** makes it possible to adjust the gripping of the foot.

At the time of the bringing down of the lever 14, the cables 40 and 41 are pulled upwards with the rear part 4 of the shaft, bringing about gripping of the instep and of the foot.

I claim:

1. A ski boot consisting of a shell surrounding the foot and the heel and of a shaft consisting of a front part and of a rear part capable of being tilted towards the rear in order to free the foot and to allow the boot to be put on and taken off, in which the rear part of the shaft can perform a translation movement in addition to a rotation movement, wherein the rear part of the shaft is connected, on the one hand, in its lower part to the shell by a first means of connection forming axes of articulation with the shell and rear part of the shaft respectively, which allows a rotation and translation of said rear part in relation to an axis which is defined and fixed in relation to the shell and on the other hand, in its upper part to the front part of the shaft by a second means of connection forming axes of articulation with the front part and the rear part of the shaft, respectively which allows a rotation and translation of said rear part in relation to an axis which is defined and fixed in relation to the front part, the axes of the articulations of the means of connection on the rear part of the shaft being situated, in the closed position of the boot, on one side and the other of the plane containing the axes of the articulation of the means of connection of the shell and the front part of the shaft.

2. The boot as claimed in claim 1, wherein one at least of the means of connection consists of two links.

3. The boot as claimed in claim 1, wherein the two means of connection consist of links.

4. The boot as claimed in claim 2, in which the means of connection of the rear part of the shaft to the shell consists of links and in which the front part of the shaft is articulated on the shell, wherein said links are articulated about the axis of articulation of the front part of the shaft.

5. The boot as claimed in claim 2, comprising means of gripping the foot which are situated on the inside of the boot and which are acted upon by at least one cable attached to a tension device mounted on the rear of the boot, wherein the cable penetrates the shell of the boot at a point coinciding at least approximately with the articulation, respectively the pivot, of the lower part of the rear part of the shaft when the latter is completely open, so that in the first part of the closing movement of the shaft, which corresponds essentially to a rotation, the traction on the cable is practically zero.

6. The boot as claimed in claim 1, wherein the means of connection of the upper part of the rear part of the shaft to the front part consist of one of the arms of two levers, the operation of which ensures the closing and the opening of the boot.

7. The boot as claimed in claim 6, wherein, in the closed position, said lever arms also ensure the tightening of the shaft around the leg by means of a toggle joint effect.

8. The boot as claimed in claim 7, wherein the two lever arms are joined together in one single piece in the form of a stirrup.

9. The boot as claimed in claim 7, wherein one of the levers can be operated manually and the other lever is operated by the first lever by means of a cable.

10. The boot as claimed in claim 9, wherein the cable passes inside a sheath which extends over the shell, that end of the sheath close to the manual lever being fixed to the front part of the shaft, whereas the other end of the sheath is mounted slidably in a bush fixed to the front part, the travel of the sliding end in the bush being sufficient in order to allow the closing of the boot.

11. The ski boot as claimed in claim 1, wherein the means of connection of the upper part of the rear part of the shaft to the front part are connected to the rear part of the shaft by means of an auxiliary piece, the position of which is adjustable forwards and backwards.

12. The ski boot as claimed in claim 11, wherein said auxiliary piece is a rigid U-shaped piece, the arms of which extend on each side of the boot and which is provided with a nut mounted on a screw fixed perpendicularly to the rear part of the shaft.

13. The ski boot as claimed in claim 8, wherein that part of the stirrup connecting the two lever arms is provided with a bolt which is mounted resiliently and comes to engage automatically on the rear part of the shaft.

14. The ski boot as claimed in claim 13, wherein the rear part of the shaft has a cut-out into which the transverse part of the stirrup comes to fit.

15. The ski boot as claimed in claim 8, wherein that part of the stirrup which connects the two lever arms is provided with a rotary button which is integral with an eccentric which comes to abut against a stop formed on the shell for the adjustment of the inclination of the shaft of the boot.

16. The ski boot as claimed in claim 15, wherein the bolt is mounted on the pin connecting the button to the eccentric, so that the bolt can be unlocked by means of said button.

17. The ski boot as claimed in claim 8, comprising means of gripping the foot which are situated on the inside of the boot and which are acted upon by two cables, one end of which is attached to the shell and the other end is attached to a tension means mounted on the rear of the boot, wherein the tension means consists of said levers.

18. The ski boot as claimed in claim 17, wherein the cables are fixed on each of the lever arms by means of a screw/nut device and the cables are guided in the two lever arms.

* * * * *